US006821173B2

(12) United States Patent
McCausland et al.

(10) Patent No.: US 6,821,173 B2
(45) Date of Patent: Nov. 23, 2004

(54) REMOVABLE AND ADJUSTABLE SURF FIN SYSTEM

(75) Inventors: Bill McCausland, Newport Beach (AU); Graeme Bennett, Newport Beach (AU); Gary Mountford, Newport Beach (AU)

(73) Assignee: Sunbum Pty., Ltd., Sydney (AU)

( * ) Notice: Subject to any disclaimer, the term of this patent is extended or adjusted under 35 U.S.C. 154(b) by 0 days.

(21) Appl. No.: 10/371,280

(22) Filed: Feb. 21, 2003

(65) Prior Publication Data

US 2003/0124924 A1 Jul. 3, 2003

Related U.S. Application Data

(62) Division of application No. 09/990,919, filed on Nov. 13, 2001, now abandoned.

(51) Int. Cl.[7] ..... B63B 1/00
(52) U.S. Cl. ..... 441/79; 114/39.15
(58) Field of Search ..... 441/74, 79; 114/39.15, 114/127, 140

(56) References Cited

U.S. PATENT DOCUMENTS

| | | | | | |
|---|---|---|---|---|---|
| 3,422,471 | A | | 1/1969 | Morey et al. | |
| 3,516,099 | A | | 6/1970 | Morey et al. | |
| 3,585,663 | A | | 6/1971 | Johnson | |
| 3,659,300 | A | | 5/1972 | Johnson | |
| 4,320,546 | A | | 3/1982 | Knox | |
| 4,379,703 | A | | 4/1983 | Mitzell | |
| 4,421,492 | A | | 12/1983 | Leva | |
| 4,493,665 | A | | 1/1985 | Liddle | |
| 4,804,347 | A | * | 2/1989 | Ross | 441/79 |
| 5,030,151 | A | * | 7/1991 | Beacham | 441/79 |
| 5,215,488 | A | | 6/1993 | Bailey | |
| 5,328,397 | A | | 7/1994 | Whitty | |
| 5,464,359 | A | | 11/1995 | Whitty | |
| 5,503,581 | A | | 4/1996 | McCullough | |
| 5,649,846 | A | | 7/1997 | Harper et al. | |
| 5,672,081 | A | * | 9/1997 | Whitty | 441/79 |
| 5,830,025 | A | * | 11/1998 | Fleming | 441/79 |
| 5,934,962 | A | | 8/1999 | Daum et al. | |
| 5,934,963 | A | | 8/1999 | Frizzell | |
| 5,951,347 | A | | 9/1999 | Hudson et al. | |
| 5,975,974 | A | * | 11/1999 | McCausland | 441/79 |
| 5,997,376 | A | * | 12/1999 | Block et al. | 441/79 |
| 6,139,383 | A | * | 10/2000 | Jolly et al. | 441/74 |
| 6,213,044 | B1 | | 4/2001 | Rodgers et al. | |
| 6,386,933 | B1 | | 5/2002 | Rewald et al. | |
| 2004/0035346 | A1 | * | 2/2004 | Davey et al. | 114/152 |

FOREIGN PATENT DOCUMENTS

| | | |
|---|---|---|
| AU | A34088/93 | 9/1993 |
| AU | B-59373/94 | 8/1994 |
| AU | A-81502/94 | 12/1994 |
| DE | 29 49 431 A1 | 6/1981 |
| DE | 33 39 686 A1 | 5/1995 |
| EP | 0 033 072 | 8/1981 |
| EP | 0 473 207 | 3/1992 |
| FR | 2 699 969 | 7/1994 |
| GB | 1149184 | 4/1969 |
| WO | PCT/AU89/00395 | 9/1989 |
| WO | PCT/AU98/00897 | 10/1998 |

* cited by examiner

*Primary Examiner*—Andrew Wright
(74) *Attorney, Agent, or Firm*—Squire, Sanders & Dempsey, LLP

(57) ABSTRACT

A fin plug assembly to receive and engage a fin includes a cavity, a cam with gears, and a worm gear. The fin plug assembly allows a quick and easy fore-aft adjustment of the fin. Disclosed also is a method of installing the fin plug assembly in a surfboard using a one-piece complete control jig system including the step of providing additional structural strength by removing and/or spiking the foam material in the body of the surfboard.

26 Claims, 5 Drawing Sheets

FIG. 1
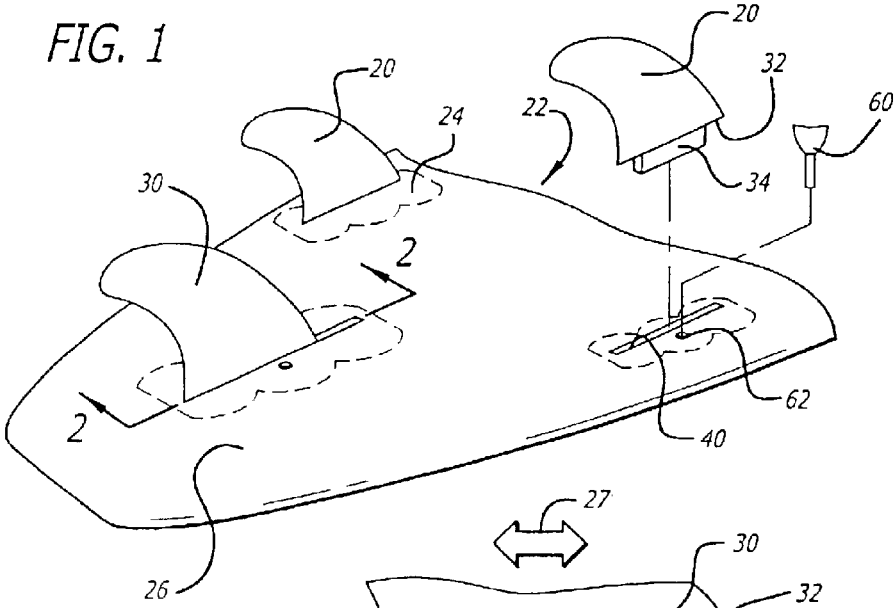
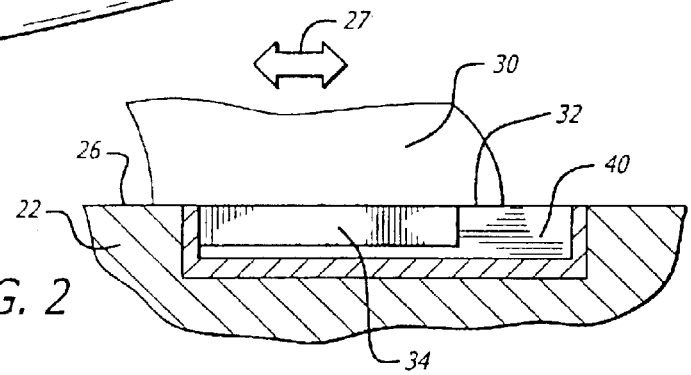
FIG. 2
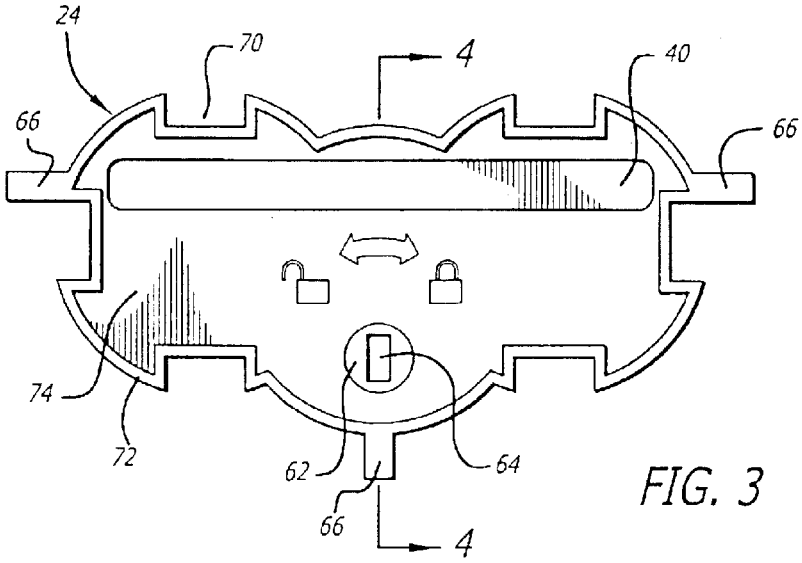
FIG. 3

FIG. 11
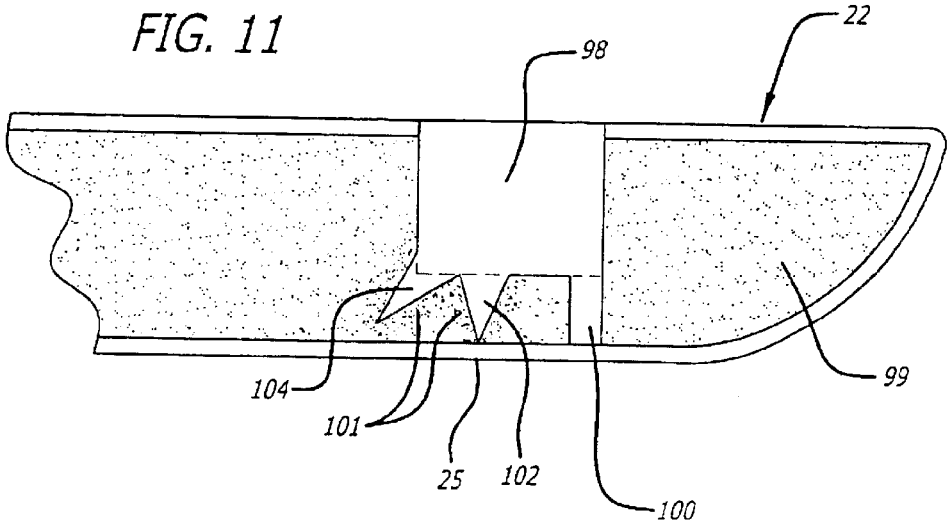
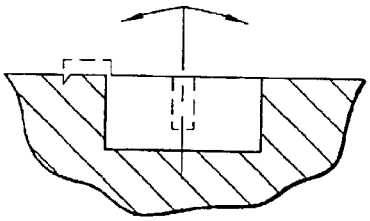
FIG. 12A
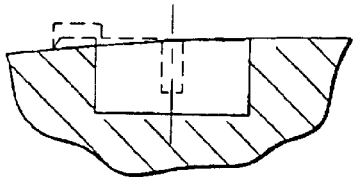
FIG. 12B
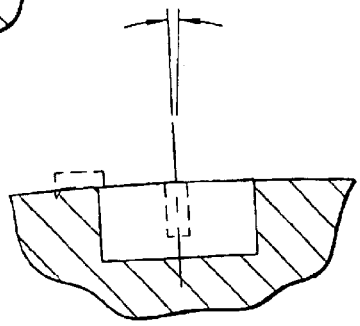
FIG. 12C

REMOVABLE AND ADJUSTABLE SURF FIN SYSTEM

RELATED APPLICATIONS

This application is a divisional of U.S. patent application Ser. No. 09/990,919, filed Nov. 13, 2001, now abandoned entitled "Removable and Adjustable Surf Fin System," which is hereby incorporated by reference.

BACKGROUND OF THE INVENTION

1. Field of the Invention

This invention relates to a removable and adjustable fin system for surfcraft such as surfboards, and a method for installing the fin system on a surfboard.

2. Related Art

In the manufacture of surfboards, a body of plastic foam material is shaped and then covered with a layer of fiber-reinforced resin, normally fiberglass. The body of surfboards has an upper side or ride surface for supporting a surfer and a lower surface which is directed into the water. One or more fins, most commonly three, are fixed to the body of the surfboard on the lower surface. The fins may be fixed permanently to the board, for example, by utilizing fiber-reinforced resin around the base of the fin.

There are, however, many disadvantages to permanently mounting a fin to a surfboard in that the fin cannot be easily removed and replaced when the fin is damaged or when it is desirable to replace the fin with another fin having different hydrodynamic performance properties. Further, it may be desirable to remove the fins to minimize the potential for damage to the surfboard or to the fins during transport and storage. In order to accommodate removal and overcome the disadvantages of permanent mounting, fin assembly systems that allow removal of the fins from the surfboards have been developed. Such removable fin systems are disclosed, for example, in the U.S. Pat. Nos. 5,328,397 and 5,975,974. The removable fin systems known in the art have shortcomings, however, and there is room for improvement.

The existing fin systems require physical maneuvering, i.e. loosening of small grub screws, before the fins can be installed or removed from the surfboard. Further, in most systems, an Allen key or other special tool is required and damage or corrosion of the grub screws may make the removal and replacement process difficult and time consuming. In addition, existing systems do not provide for an easy adjustment of the fins once installed. It is often desirable to change the fore-aft position of the fins, in particular, the rear or center fin, depending on the surf conditions and the desired surfboard performance. Current fin systems are designed for fixed or limited positions where the fins are inserted and secured, and provide no or difficult adjustment capability to move the fins forward or backward once installed.

Other problems associated with existing systems relate to the installation of the fin fixing system into the body of the surfboards. The two-plug fixing system as described in the U.S. Pat. No. 5,328,397, for example, requires the accurate alignment of the plugs at a predetermined spacing of the plugs during the installation process. Any slight offset of the plugs may result in a less than perfect alignment of the plugs and could make it difficult or impossible to install the fins. The plugs could also lose alignment due to physical stress and tempering on the surfboards during the installation process. Further, the installation methods known in the art often require multiple marking and positioning jigs or templates and other tools and accessories, i.e. putty, tape, foam, center punch, etc. More significantly, conventional installation methods typically involve multiple steps of marking, positioning, removal and repositioning of the jigs or templates, and are often difficult and time-consuming. It would therefore be desirable to have a complete control jig system that would allow an easy and accurate installation of a fin fixing system.

Therefore, there is a need for a fin fixing system that allows a convenient and quick installation, removal, and adjustment of the fins. An installation jig system that would allow an easy and accurate installation of a surf fin fixing system in a surfboard would also be a useful improvement.

BRIEF SUMMARY OF THE INVENTION

One of the features of the invention is to provide a fin plug assembly to be embedded in the body of a surfcraft such as a surfboard that allows an easy installation, securing, and removal of a fin. Further, the fin plug assembly of the present invention allows an easy adjustment of the fore-aft positioning of the fin within the fin plug assembly.

In one embodiment, a fin plug assembly includes a cavity to receive a fin and a cam adapted to rotate and secure the fin tab when received in the cavity. The fin plug assembly includes a worm gear adapted to engage the teeth or gears of the cam which can be turned using a key, a screw driver, or any other device which can be inserted into a slot in the worm gear and turn the worm gear. Further, the fin plug assembly of the present invention allows the fore-aft movement/positioning of the surf fin within the cavity by rotating the cam which is controlled by a simple turn of the worm gear. The fin plug assembly also allows a user to adjust the tightness of the fit between the cam and the fin by controlling the degree or extent of the worm gear rotation.

Another aspect of the present invention is to provide a one-piece complete control jig system which allows an easy and accurate installation of the fin plug assembly in a surfboard. The complete jig system includes a peel-off bottom portion which can be placed on and preferably adheres to the surface of the surfboard where the fin plug assembly is to be installed. The complete jig system according to the present invention has a perforated and removable center portion providing a template or guide for a trimmer, a router or other cutting device to form a cavity in the surfboard into which the fin plug assembly can be mounted. The complete jig system also serves as a dam to hold resin poured to fix and hold the fin plug assembly. Preferably, the complete jig system also provides a plurality of removable tabs on which the outer supports or outriggers of the fin plug assembly may be positioned during the installation process to properly align the fin plug assembly with the surface of the surfcraft. The complete jig system of the present invention is a one-piece, multiple-function installation device which allows an easy, quick and accurate installation of the fin plug assembly without having to utilize multiple jigs and other tools of the conventional systems.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 1 is an exemplary view illustrating how fins are installed in fin plug assemblies on the lower surface of a surfboard according to one embodiment of the present invention;

FIG. 2 is a cross sectional view of the fin plug assembly and the fin of FIG. 1 along the line 2—2 in FIG. 1;

FIG. 3 is a perspective top view of the fin plug assembly according to one embodiment of the invention;

FIG. 11 is a cross sectional view of the surfboard and a mounting cavity formed therein according to one embodiment of the present invention;

FIG. 12A is a cross-sectional view of positioning the fin plug assembly within the mounting cavity with a plurality of arms into corresponding depth cut outs; and FIGS. 12B and 12C illustrate cross-sectional views of adjusting a vertical tilt angle of the fin plug assembly.

DETAILED DESCRIPTION OF THE PREFERRED EMBODIMENTS

Figure 4:
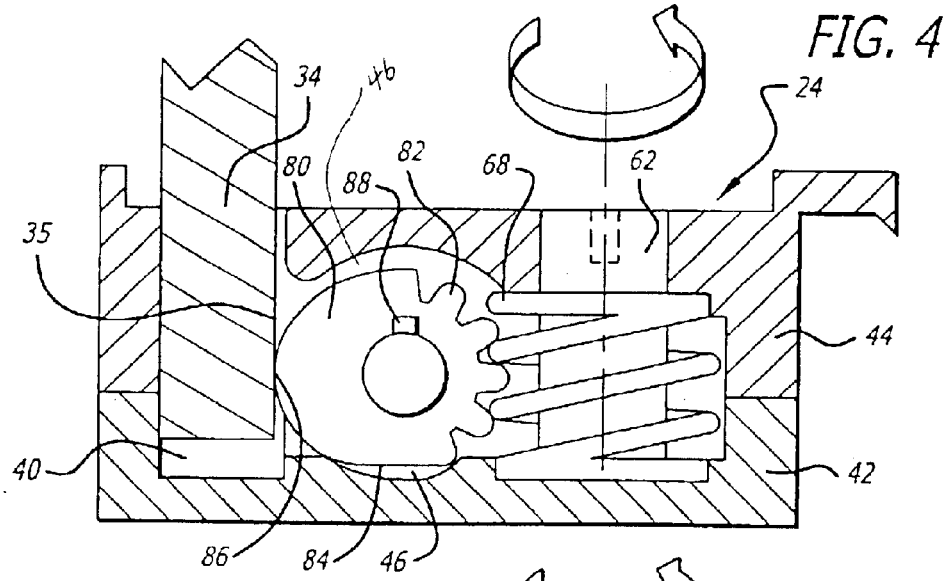
FIG. 4 is a cross sectional view of the fin plug assembly along the line 4—4 in FIG. 3 according to one embodiment of the present invention.

This description is not to be taken in a limiting sense, but is made for the purpose of illustrating the general principles of the invention. The section titles and overall organization of the present detailed description are for the purpose of convenience only and are not intended to limit the present invention.

FIG. 1 illustrates by way of example how fins 20, 30 are installed in a surfboard 22 using fin plug assemblies 24 of the present invention. FIG. 1 shows a lower surface 26 of a surfboard 22 which is received in the water. The other side of the surfboard (not shown) is an upper ride surface for supporting a surfer. A center or rear fin 30 as well as two side fins 20 may be installed into the fin plug assemblies 24 (shown by dotted lines). The fin plug assemblies 24 for both the rear fin 30 and the side fins 20 may have the same size, but typically the fin plug assembly 24 for the rear fin 30 is larger than the fin plug assemblies 24 for the side fins 20 as shown in FIG. 1.

Generally, the side fins 20 and the rear fin 30 have an end surface 32 and one or more tabs 34 extending from the end surface 32. The tab 34 is configured to be received in a cavity 40 of the fin plug assembly 24, and the side fin 20 or the rear fin 30 is secured within the fin plug assembly 24 by inserting a key 60 into a slot 64 (FIG. 3) of a worm gear 62 and turning the key 60. When the side fin 20 or the rear fin 30 is properly installed, the end surface 32 preferably abuts against the fin plug assembly 24 and sits substantially flush with the lower surface 26 of the surfboard 22 and a top surface 74 (FIG. 3) of the fin plug assembly 24.

In FIG. 1, the rear fin 30 is depicted in a position at the far rear end of the cavity 40. However, by making the longitudinal length of the cavity 40 longer than that of the tab 34 of the rear fin 30, the fin 30 may be moved and positioned fore and aft within the cavity 40. The fore-aft movement/adjustment can be made quickly and easily, even in the surf. The side fins 20 may also be moved and positioned fore and aft within the cavity 40 in the same manner as described above.

The fore-aft movement/adjustment is more clearly demonstrated with reference to FIG. 2, which shows a cross-sectional view of the fin plug assembly 24 and the rear fin 30 along the line 2—2 of FIG. 1. In one embodiment of the present invention, the fin plug assembly 24 allows the fore-aft movement of the rear fin 30 up to around 15 mm. The fore-aft movement of the side fins 20 is usually more restricted, allowing for displacement of only up to around 5 mm. The 5–15 mm movement allowance is, however, not absolute and a greater or lesser allowance may be easily achieved by either making the cavity 40 longer or the tab 34 shorter.

The cross sectional view in FIG. 2 shows the rear fin 30 with the tab 34 received in the cavity 40. The end surface 32 of the fin may abut against and sit substantially flush with a portion of the lower surface 26 of the surfboard 22 and the top surface 74 of the fin plug assembly 24. As shown in FIG. 2, the rear fin 30 may be moved forward or backward along the direction indicated by the arrow 27, and the rear fin 30 may be moved to the foremost position or anywhere between the fore and aft positions, and locked in place.

FIG. 3 shows a perspective top view of the fin plug assembly 24 according to one embodiment of the present invention. The fin plug assembly 24 is to be embedded into the surfboard 22 as shown in FIGS. 1 and 2. As shown in FIG. 3, the fin plug assembly 24 has the cavity 40 to receive the fin 20, 30, and a worm gear 62 with a generally rectangular shaped slot 64 to receive a key 60 (shown in FIG. 1). The fin plug assembly 24 in FIG. 3 is generally shaped as three overlapping cylinders, and has three temporary supports or outriggers 66 for positioning the fin plug assembly 24 on the lower surface 26 of the surfboard 22 during installation. The fin plug assembly 24 also has a plurality of recesses 70 and a collar 72 projecting upwardly from the top surface 74 thereof around the peripheral edge of the fin plug assembly 24. The role of the outriggers 66, recesses 70 and the collar 72 will be discussed in more detail hereinafter.

Different shapes, i.e. rectangular, oval, square, etc., for the fin plug assembly 24 may be used, and the three overlapping cylinder shape of the fin plug assembly 24 is not meant to be restrictive or limiting.

The details of the fin plug assembly 24 and the operation and inter-relationship between the worm gear 62 and an associated cam 80 are illustrated by an exemplary cross sectional view shown in FIG. 4. The worm gear 62 is vertically aligned within the fin plug assembly 24. The slot 64 of the worm gear 62 is substantially rectangular as shown, but it could be in any appropriate shape. The key 60, a screwdriver, a car or house key or other similarly shaped device may be inserted into the slot 64 to turn the worm gear 62.

Located within the fin plug assembly 24 is the cam 80 which is horizontally placed and has gears or teeth 82. The cam 80 is adapted to fit with the worm gear 62 and rotate and engage the tab 34 of the fin 20, 30. The term "horizontal" used herein refers to the alignment which is longitudinally parallel to the cavity 40 of the fin plug assembly 24.

In the embodiment shown in FIGS. 3 and 4, turning the worm gear 62 in the clockwise direction is designed to rotate the cam 80 to hold or engage the tab 34 of the fin 20, 30 inserted into the cavity 40, while turning the worm gear 62 in the counter-clockwise direction allows the cam 80 to disengage the tab 34 of the fin 20, 30 from the fin plug assembly 24.

As illustrated in FIG. 4, the fin plug assembly 24 includes a lower part 42 and an upper part 44, which are as a final product sealed together using an ultrasonic welding process or other methods well known in the art. Positioned in the fin plug assembly 24 is the worm gear 62 having a plurality of gears or teeth 68, and the worm gear 62 is vertically placed within the fin plug assembly 24 as shown in FIG. 4. The upper part 44 and the lower part 42 of the fin plug assembly 24 form a built in bearing 46 which is adapted to receive the cam 80. The cam 80 is positioned in the bearing 46 between the worm gear 62 and the cavity 40. The cam 80 has a plurality of matching gears or teeth 82 to fit with the gears 68 of the worm gear 62. The cam 80 has a flat or disengaging portion 84 and a bulging or engaging portion 86.

The cam 80 is generally circular in shape except in the flat portion 84 and in the region where the gears 82 are positioned. The phrase "bulging portion" used herein refers to the generally circular portion of the cam 80 which is aligned with and engages the tab 34 of the fin 20, 30. Alternatively, the bulging portion may be designed to protrude outwardly relative to the truly circular portion of the cam 80. For example, the bulging portion may have an oval shape to make it better fit with the tab 34 of the fin 20, 30. The phrase "bulging portion" used herein therefore means the portion of the cam 80 which is aligned with and engages the tab 34, whether it is substantially circular or alternatively, oval or protruding relative to the truly circular part of the cam.

The cam 80 rotates smoothly on its axle 87 (FIG. 7) within the bearing 46 relative to its horizontal axis, and has a stopper 88 on each end of the cam. The bearing 46 has a shape that is substantially similar to that of the cam 80 and is also shaped to receive the stoppers 88 and the axle 87 (FIG. 7) located in each end of the cam 80. The fin plug assembly 24 is designed so that an engaging position is achieved by turning the worm gear 62 in a pre-selected direction, i.e., clockwise in the embodiment shown in FIGS. 2 and 4, and a disengaging position is achieved by turning the worm gear 62 in the opposite direction, i.e. counter clockwise. Given the relative configuration of the worm gear 62 and the cam 80, clockwise rotation causes the cam 80 to engage the tab 34 of the fin 20, 30 with both a horizontal and vertical force thus pulling the tab 34 down into the cavity 40 and increasing the integrity of the engagement of the fin 20, 30.

FIG. 4 illustrates how the cam 80 is rotated to the engaging position by turning the worm gear 62. In the engaging position, the bulging portion 86 of the cam 80 abuts a side surface 35 of the tab 34 of the fin 20, 30, and creates sufficient friction to prevent the fin from moving or dislodging. When the cam 80 is rotated to the disengaging position, the flat portion 84 is aligned with the side surface of the tab 34, and this allows easy removal/insertion of the fin from/into the cavity 40 and fore/aft adjustment of the position of the fin 20, 30 in the cavity 40. Thus, the present fin plug assembly is designed to receive and secure the fin by controlling the rotation of the cam 80 and aligning the tab 34 of the fin with either the bulging portion 86 or the flat portion 84 of the cam 88. Unlike other known systems, the cam 80 is not designed to extend forward or retract backward to bear against the tab 34 to secure the fin.

The fin plug assembly 24 may be made of a relatively hard plastic or other similar material well known in the art. Preferably, the cam 80 and the worm gear 62 are made of a harder material, i.e. engineering grade plastic, which is less susceptible to distortion, twist, bending, or chipping.

Because both the cam 80 and the tab 34 are relatively hard, it may be desirable to incorporate softer, malleable rubber materials on certain areas of the tab 34 and/or the bulging portion 86 of the cam 80 to create a more versatile friction fit. By incorporating certain rubber materials, when the cam 80 is rotated to the engaging position, the friction between the bulging portion 86 and the tab 34 may be increased or decreased to provide a more or less secure fit as desired or provide a desired controlled friction. In other words, the malleable rubber material incorporated in the tab 34 and/or the cam 80 allows flexibility and control over the friction desired between the tab 34 and the cam 80, and the force required to cause the fin to be pulled from the fin plug assembly under sudden impacts may also be controlled.

Figure 5:
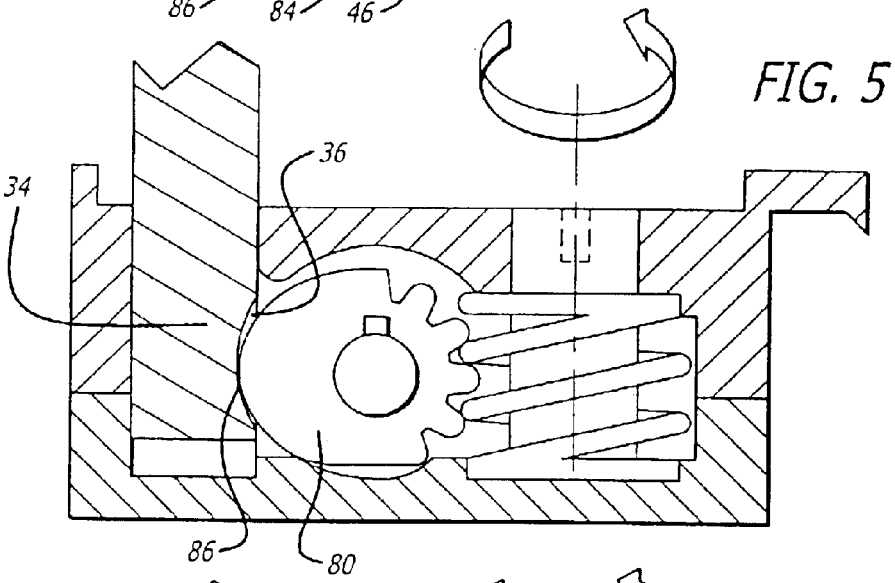
FIG. 5 is a cross sectional view of the fin plug assembly along the line 4—4 in FIG. 3 according to another embodiment of the present invention.
Figure 6:
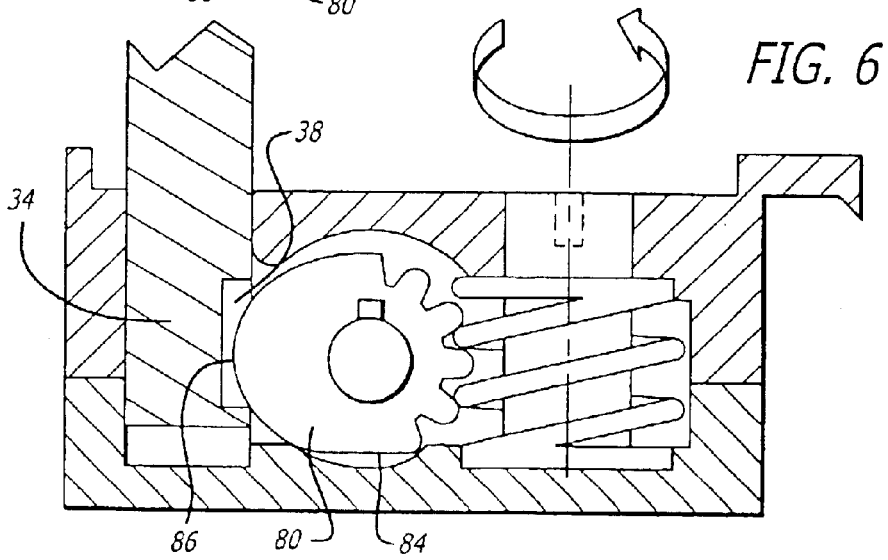
FIG. 6 is a cross sectional view of the fin plug assembly along the line 4—4 in FIG. 3 according to yet another embodiment of the present invention.

FIG. 5 is a cross sectional view of the fin plug assembly 24 according to another embodiment of the present invention. The cam 80 is rotated to the engaging position in FIG. 5 so that the bulging portion 86 is received in a concave portion 36 of the tab 34. The concave portion 36 on the tab 34 has a substantially curved shape and is designed to receive and bear against the bulging portion 86 of the cam 80. Alternatively, as shown in FIG. 6, the tab 34 may include a cut out portion 38 which is designed to receive the bulging portion 86 of the cam 80. The embodiment shown in FIG. 6 allows greater flexibility in the alignment of the tab 34 and the cam 80.

In summary, shown in FIGS. 1–6 is a surf fin plug assembly 24 in which turning the worm gear 62 in one direction allows the bulging portion 86 of the cam 80 to align with and engage the tab 34 and secure the fin which is inserted into the cavity 40, while turning the worm gear 62 in the opposite direction allows the flat portion 84 of the cam 80 to align with and disengage the tab 34 for removal or adjustment of the fin.

The fin plug assembly 24 may be used for both the side fins 20 and the rear fin 30. However, the fin plug assembly 24 used for the rear fin 30 may be larger to allow a greater fore-aft movement of the rear fin 30. In addition, as described in more detail below, the fin plug assembly 24 used for the side fins 20 may have a vertical built-in tilt angle while the fin plug assembly 24 for the rear fin 30 preferably does not.

Figure 7:
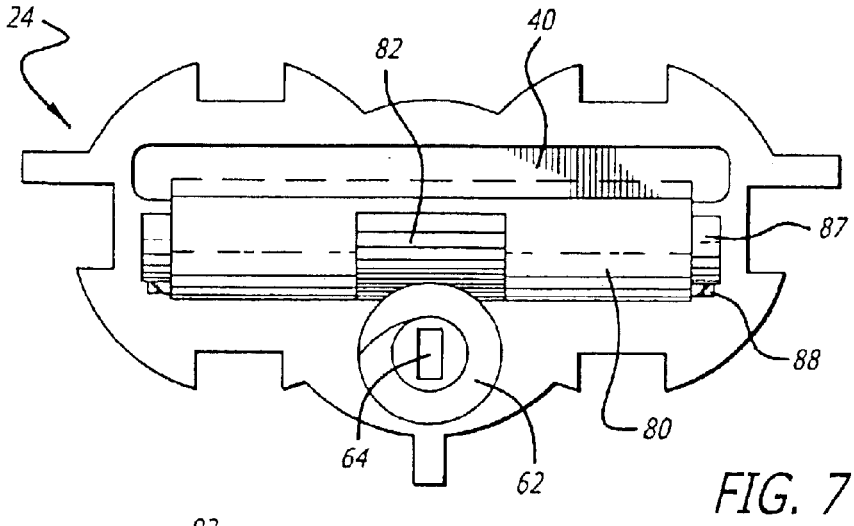
FIG. 7 is a perspective inside view of the fin plug assembly according to one embodiment of the invention.

FIG. 7 illustrates more clearly the positioning and relationship between the worm gear 62, the cam 80, and the cavity 40 of the fin plug assembly 24. The cam 80 on each of the two ends has an axle 87 and the stopper 88. The cam 80 also has a plurality of teeth or gears 82 which are designed to fit with the gears of the worm gear 62. By turning the worm gear 62 in one direction, i.e., clockwise, the cam 80 is rotated to engage the bulging portion of cam 80 against the tab 34 of the fin received in the cavity 40. The worm gear 62 has the slot 64 which is substantially rectangular to receive a specially designed key, a screwdriver, a car or house key or other similarly shaped device. The slot 64 of the worm gear 62 may be of any appropriate shape. The fin plug assembly 24 of the present invention also allows a gradual tightening or adjustment of the fin by turning the worm gear 62 only partially or to the point of the desired tension.

As shown in FIGS. 1 and 7, the fin 20, 30 generally has a body portion and a mounting portion. The body portion defines a hydrodynamic foil and is configured to extend generally perpendicularly relative to the lower surface 26 of the surfboard 22. The mounting portion is attached to the body portion and is configured to be received and frictionally held in the cavity 40 of the fin plug assembly 24. The mounting portion preferably includes at least one tab 34 and may incorporate malleable rubber materials to control the friction between the tab 34 and an engaging means, i.e., the cam 80, of the fin plug assembly 24.

Described now is the installation process of fin plug assemblies using a complete control jig system 90 according to the present invention. Typically, installation of the fin plug assemblies known in the art requires multiple marking and positioning jigs or templates and other tools and accessories, i.e. putty, tape, foam, center punch, etc. In addition, the conventional installation methods require multiple steps of marking, positioning, removal, and repositioning of the jigs or templates that are often difficult, inaccurate, and time-consuming. The complete control jig system 90 of the present invention allows an easy, quick, and accurate installation of fin plug assemblies.

Figure 8:
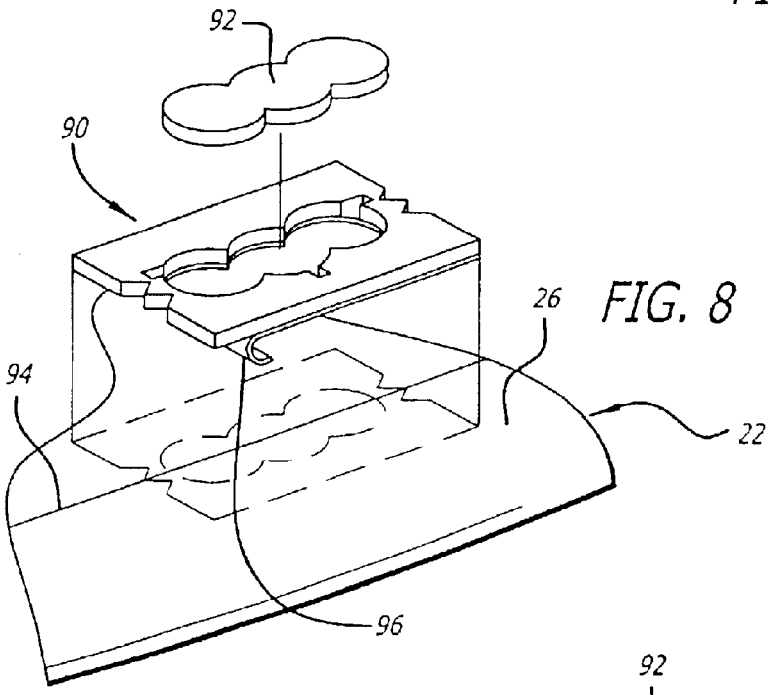
FIG. 8 is a perspective view of a complete jig system according to one embodiment of the invention.
Figure 9:
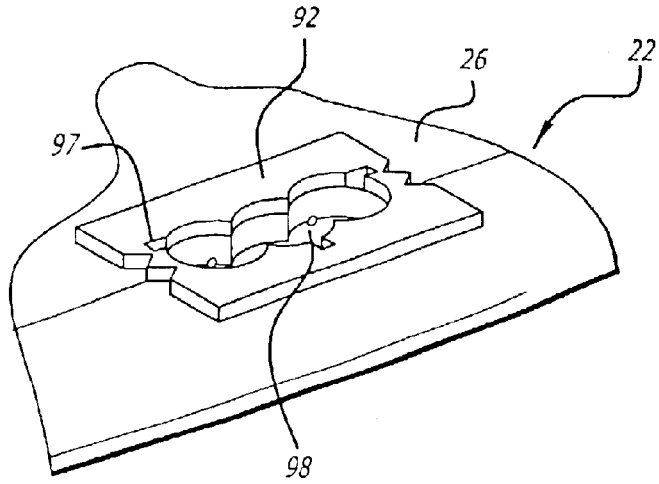
FIG. 9 is another perspective view of the complete jig system according to one embodiment of the invention.

FIGS. 8 and 9 illustrate by way of example a complete control jig system 90 and a method of installing the fin plug assembly using the complete control jig system 90. FIG. 8 shows the complete jig system 90 having a pre-cut center portion 92 which is substantially the same shape as the fin plug assembly to be installed. For the purpose of illustration, the fin plug assembly to be installed is the assembly shown in FIGS. 1–7 and described above.

The complete control jig system 90 is used to install the fin plug assembly generally utilizing the following process. Before the complete control jig system 90 is placed on the lower surface 26 of the surfboard 22, the surface area where the fin plug assembly is to be installed is generally sanded. Then, marks are made on the surface marking the spots where the front and rear ends of the fin will be after the fin plug assembly is installed, and a line 94 is drawn through the marks. FIGS. 8 and 9 illustrate the positioning of the complete control jig system 90 for a side fin plug assembly. Once the line 94 is drawn, a peel-off cover 96 on the bottom of the complete control jig system 90 is removed, preferably exposing a self-adhesive surface, and the complete control jig system 90 is positioned along the line 94 as shown in FIGS. 8–9. The bottom portion of the complete control jig system 90 includes glues, and is positioned on the lower surface 26 of the surfboard 22. When placed on the lower surface 26 of the surfboard 22, the center portion 92 is removed from the complete control jig system 90.

Once the complete control jig system 90 is properly placed on the lower surface 26 of the surfboard 22 and the center portion 92 is removed, a drill with a hole-cutting device, router or other cutting device is used to create a mounting cavity 98 within the surfboard 22. The complete control jig system 90 is designed to guide the drill, router or other cutting device as it is moved around forming the mounting cavity 98. Once the mounting cavity 98 is formed, depth cut outs 97 are removed from the complete control jig system 90 and the surf fin plug assembly 24 as shown in FIG. 7 is positioned within the mounting cavity 98. The depth cut outs 97 are removed from the complete control jig system 90 so that the outriggers 66 (in FIG. 7) of the fin plug assembly 24 are properly aligned and touching the lower surface 26 of the surfboard 22. FIG. 12A illustrates the temporary supports or outriggers 66 positioning the fin plug assembly 24 at the appropriate height relative to the surrounding surface of the surfboard. In addition, FIG. 12A illustrates the depth cut outs aligning and postioning the supporting arms of the fin plug assembly into the depth cut outs. Preferably, a dummy fin (not shown) may be fitted into the fin plug assembly 24 before the fin plug assembly is positioned into the mounting cavity 98 to insure the proper positioning and installation of the fin plug assembly 24.

Once the fin plug assembly 24 is properly aligned and positioned within the mounting cavity 98, the space between the fin plug assembly 24 and the mounting cavity 98 within the surfboard 22 is slowly filled with a resin or other hardenable material well known in the art. The complete control jig system 90 is preferably high enough to act as a dam to contain the liquid resin or other hardenable material from overflowing. After the resin or hardenable material has set, the complete control jig system 90, the outriggers 66 and the collar 72 (in FIG. 3) of the fin plug assembly 24 are then sanded off so that the top surface 74 of the fin plug assembly 24 is substantially flush with the lower surface 26 of the surfboard 22. The complete control jig system should thus be made of materials suitable for removal by sanding.

Also, as illustrated by a way of example in FIG. 11, the foam material 99 in the body of the surfboard 22, particularly the material extending from the mounting cavity 98 may be further removed to provide additional space 100 for resin or other hardenable material to enter, thereby increasing the stability of the fin plug assembly 24 installed. In one embodiment, a hand tool or other cutting device well known in the art may be used to remove material from a region extending from the base (which is indicated by a dotted line in FIG. 11) of the mounting cavity 98 substantially to the skin, typically fiber-glassed, of an upper surface 25 of the surfboard 22. This space 100 is filled with resin or other hardenable material to provide greater structural strength and stability to the fin plug assembly 24 which is installed in the surfboard 22.

Alternatively, a spiking tool may be used to spike material from regions extending from the side and/or the base of the mounting cavity 98 to create additional space for resin or other hardening material to enter. Such space 102, 104 may extend vertically or at an angle as shown in FIG. 11, and when a spiking tool is used, the foam material around the spiked point is also compressed and the compressed foam material 101 provides additional structural support. If needed, the space 102 created by the spiking tool can substantially touch to the skin, typically the fiber-glassed, of the upper surface 25 of the surfboard 22.

The complete control jig system 90 of the present invention also allows an easy adjustment of the tilt angle for the fins. As discussed above, it may be desirable for the fins to have a vertical tilt angle. Typically, the side fins are vertically tilted toward the outwardly direction at about 4°. The term "outwardly" used herein refers to the direction opposite to the center portion of the surfboard 22. The rear fin 30 usually does not require a tilt angle. To accommodate the desired tilt angle for the side fins, the fin plug assembly 24 for the side fins 20 according to the present invention has a built-in tilt angle, typically 3°–5°, and preferably 4°.

As illustrated in FIGS. 12B and 12C, if it is desirable to have a tilt angle greater than 3°–5°, a small amount of putty may be pushed into the depth cut outs 97 of the complete control jig system 90. The fin plug assembly 80 can now be tilted using the putty to control the depth of the outriggers 66.

The complete control jig system 90 controls and guides the installation of fin plug assemblies 24. The installation process utilizing the complete control jig assembly 90 of the present invention is easy, accurate and less time consuming, and provides a significant improvement compared to other conventional systems.

Figure 10:
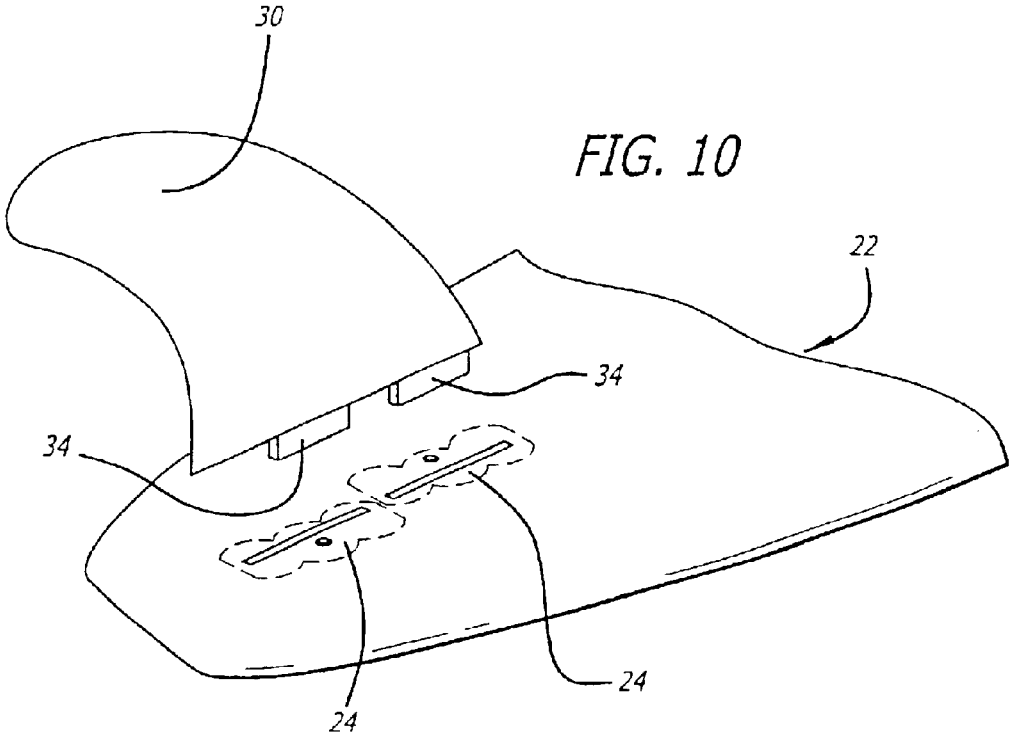
FIG. 10 is an exemplary view of the fin plug assemblies and a center fin according to one embodiment of the present invention.

FIG. 10 is an exemplary view illustrating how multiple units of the fin plug assembly 24 according to the present invention may be used to fix the fin 30 with multiple tabs 34. Shown in FIG. 10 are two fin plug assemblies 24 embedded within the surfboard 22. The arrangement shown in FIG. 10 is particularly useful for securing larger rear fins which require greater anchoring. The rear fin 30 in FIG. 10 has two tabs 34, and each tab 34 may be inserted and secured into a separate fin plug assembly 24. Alternatively, each fin plug assembly 24 may also receive one and more tabs 34.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A method of installing a fin plug assembly in a surfboard comprising:

positioning a control jig system on a lower surface of said surfboard where said fin plug assembly is to be embedded;

removing a center portion of said control jig system;

creating a mounting cavity within said surfboard, said mounting cavity having a substantially same shape and size as said center portion;

positioning said fin plug assembly within said mounting cavity, wherein said fin plug assembly has a plurality of supporting arms;

removing depth cut outs of said control jig system;

aligning and positioning said supporting arms of said fin plug assembly into said depth cut outs;

filling said mounting cavity with a resin; and sanding off said control jig system, a top surface and said supporting arms of said fin plug assembly.

2. A method of claim 1, further comprising fitting a dummy fin into said fin plug assembly.

3. A method of claim 1, further comprising placing a variable amount of putty into said depth cut outs and adjusting a vertical tilt angle of said fin plug assembly.

4. A method of claim 1, wherein said center portion and said depth cut outs are pre-cut.

5. A method of claim 1, wherein said center portion is in a substantially same shape as an outline of said fin plug assembly.

6. A method of claim 1, further comprising removing materials extending from said mounting cavity and creating a space for said resin to fill.

7. A method of claim 6, said space extends substantially to a skin of an upper surface of said surfboard.

8. A method of claim 1, further comprising spiking and compressing materials extending from said mounting cavity.

9. A method of claim 8, said spiking extends substantially to a skin of an upper surface of said surfboard.

10. A method of adapting a surfboard to couple to a fin having a tab, the method comprising:

forming a mounting cavity within the surfboard guided by a control jig system where the tab of the fin is to be embedded;

spiking material which extends beyond the mounting cavity so as to form at least one spiked cavity extending from the mounting cavity;

positioning a fin plug assembly within the mounting cavity at a predetermined depth, where the fin plug assembly is adapted to receive the tab of the fin;

coupling the fin plug assembly to the surfboard; and smoothing the surface of the surfboard until the fin plug assembly is substantially flush with the surface of the surfboard.

11. The method according to claim 10, further including:

removing additional material from the surfboard in addition to the mounting cavity to provide additional space between the fin plug assembly and an upper surface of the surfboard; and filling the additional space with resin to couple the fin plug assembly to the surfboard.

12. The method according to claim 10, where the fin plug assembly has a plurality of supporting arms, and further including:

seating the supporting arms upon the lower surface of the surfboard to place the fin plug assembly at the predetermined depth within the mounting cavity.

13. The method according to claim 10, where the control jig system has a center portion that defines the outline for the mounting cavity, and further including:

removing the center portion from the control jig system to guide in the forming of the mounting cavity.

14. The method according to claim 10, where the step of smoothing is done by sanding the surface of the surfboard.

15. The method according to claim 10, further comprising fitting a dummy fin into the fin plug assembly to align the fin plug assembly into the mounting cavity.

16. The method according to claim 10, further comprising placing a variable amount of putty adjacent to the control jig system; and adjusting a vertical tilt angle of the fin plug assembly.

17. The method according to claim 10, where the surfboard has a skin on an upper surface of the surfboard, where the step of spiking extends substantially to the skin of the upper surface of the surfboard.

18. A method of installing a fin plug assembly having a plurality of supporting arms, in a surfboard, the method comprising:

positioning a control jig system having a cut-out center portion with a plurality of depth cut-outs extending from the cut-out center portion, on a lower surface of the surfboard where the fin plug assembly is to be embedded, the depth cut-outs being adapted to receive said supporting arms;

creating a mounting cavity within the surfboard, where the mounting cavity has a profile that is substantially similar to the profile of the cut-out center portion;

positioning the fin plug assembly within the mounting cavity so that the plurality of supporting arms are received within the depth cut-outs and seated upon the lower surface of the surfboard;

filling the mounting cavity with a resin; and removing the control jig system and any protruding resin and the protruding portion of the fin plug assembly so that the lower surface of the surfboard is substantially smooth.

19. The method according to claim 18, where the step of removing is done by sanding.

20. The method according to claim 18, further comprising fitting a dummy fin into said fin plug assembly.

21. The method according to claim 18, further comprising placing a variable amount of putty into said depth cut outs and adjusting a vertical tilt angle of said fin plug assembly.

22. The method according to claim 18, where the cut-out center portion and the depth cut-outs are pre-cut.

23. The method according to claim 18, said cut-out center portion is in a substantially same shape as an outline of said fin plug assembly.

24. The method according to claim 18, further comprising removing materials extending from the mounting cavity and creating a space for the resin to fill.

25. The method according to claim 24, wherein the space extends substantially to a skin of an upper surface of the surfboard.

26. A method of claim 18, further comprising spiking and compressing materials extending from said mounting cavity.

* * * * *